US009153392B2

(12) United States Patent
Borgolte et al.

(10) Patent No.: US 9,153,392 B2
(45) Date of Patent: Oct. 6, 2015

(54) ELECTRICAL SWITCH

(71) Applicant: Siemens Aktiengesellschaft, Munich (DE)

(72) Inventors: Jörg Borgolte, Amberg (DE); Andreas Haider, Pfreimd (DE); Michael Soukup, Kuemmersbruck (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 15 days.

(21) Appl. No.: 14/225,756

(22) Filed: Mar. 26, 2014

(65) Prior Publication Data

US 2014/0374384 A1 Dec. 25, 2014

(30) Foreign Application Priority Data

Jun. 24, 2013 (DE) ..... 10 2013 211 932

(51) Int. Cl.
*H01H 9/34* (2006.01)
*H01H 9/30* (2006.01)

(52) U.S. Cl.
CPC . *H01H 9/30* (2013.01); *H01H 9/34* (2013.01); *H01H 9/346* (2013.01); *H01H 2009/305* (2013.01)

(58) Field of Classification Search
CPC ..... H01H 33/596; H01H 15/04; H01H 2009/305; H01H 9/34
See application file for complete search history.

(56) References Cited

U.S. PATENT DOCUMENTS

| | | | | |
|---|---|---|---|---|
| 5,247,142 | A * | 9/1993 | Yonkovitz et al. | 218/150 |
| 6,797,909 | B2 * | 9/2004 | Pride et al. | 218/1 |
| 2001/0027961 | A1 * | 10/2001 | Brouillat et al. | 218/154 |
| 2014/0175058 | A1 * | 6/2014 | Gentsch et al. | 218/124 |

* cited by examiner

*Primary Examiner* — Truc Nguyen
(74) *Attorney, Agent, or Firm* — Harness, Dickey & Pierce, P.L.C.

(57) ABSTRACT

An electrical switch is disclosed including a rotatably mounted contact bridge which includes a movable contact, wherein the movable contact interacts with a stationary contact of the electrical switch for the purpose of closing or opening the electrical circuit as a result of rotation of the contact bridge. In at least one embodiment, the surfaces at the point at which contact is made between the movable contact and the stationary contact are at least partially covered by a protective material for protecting against soiling and/or damage due to contact-erosion materials, wherein the protective material is a paper-like fleece.

19 Claims, 3 Drawing Sheets

ELECTRICAL SWITCH

PRIORITY STATEMENT

The present application hereby claims priority under 35 U.S.C. §119 to German patent application number DE 102013211932.1 filed Jun. 24, 2013, the entire contents of which are hereby incorporated herein by reference.

FIELD

At least one embodiment of the invention generally relates to an electrical switch, in particular a power circuit breaker. At least one embodiment of the invention also generally relates to a method for improving a switch of this kind.

BACKGROUND

Electrical power breakers often have a rotary contact system which has a fixed contact for connection to a current path, and also a rotatably mounted contact element which interacts with the fixed contact. The movable contact element, which is usually designed in the form of a bridge, serves to interrupt and to close the electrical circuit. An operating mechanism, for example in the form of a tilting lever, also called a handle, is used for manual connection and disconnection. In the event of a short circuit, the contact bridge is intended to open quickly due to electrodynamic forces, independently of the operating mechanism.

When the contact bridge is opened, a switch arc is produced between the contacts, said arc leading to a loss of material from the contacts, so-called contact erosion, at very high temperatures. The very hot, solid or gaseous contact-erosion products soil and/or damage the surfaces in the interior of the switch. This can have a considerable influence on the opening function of the switch and lead to production failures. Contact-erosion materials can also accumulate on the functional elements of the rotary contact system and prevent correct opening in the event of a short circuit owing to the resulting changing frictional conditions.

Electrical switches typically have a so-called quenching chamber. The switch arc is quenched in said quenching chamber, on which the movable contact and the stationary contact are arranged. So-called quenching plates, which are arranged around the arc such that they are electrically insulated from one another, are typically used to assist quenching. Contact-erosion materials can also accumulate between the quenching plates and lead to an electrical line between the plates, and this would reduce the effect of the plates on the arc on account of the electrical short circuit.

SUMMARY

At least one embodiment of the present invention provides an electrical switch which is protected against soiling and/or damage due to contact-erosion materials in a particularly simple manner. A switch and a method are disclosed. Advantageous embodiments of the invention are specified in the dependent claims.

The inventive switch of at least one embodiment comprises a rotatably mounted contact bridge which comprises a movable contact, wherein the movable contact interacts with a stationary contact of the electrical switch for the purpose of closing or opening the electrical circuit as a result of rotation of the contact bridge. The surfaces at the point at which contact is made between the movable contact and the stationary contact are at least partially covered by a protective material for protecting against soiling and/or damage due to contact-erosion materials, wherein the protective material is a paper-like fleece. It is advantageous here for the contact-erosion materials to be deposited preferably on the paper-like fleece and there to not adversely affect the functioning of the electrical switch. This ensures that correct opening of the switch is not impeded, even after the repeated production of contact-erosion materials.

At least one embodiment is directed to a method for improving an electrical switch, wherein the surfaces at the point at which contact is made between the movable contact and the stationary contact are at least partially covered by a protective material for protecting against soiling and/or damage due to contact-erosion materials, wherein the protective material is a paper-like fleece.

Embodiments of the invention is not restricted to the protection of electrical switches with rotary contact systems, but rather can also be employed in other kinds of switches.

BRIEF DESCRIPTION OF THE DRAWINGS

The above-described properties, features and advantages of this invention, and also the way in which they are achieved, will be explained more clearly and precisely in connection with the following description of the example embodiments which will be explained in greater detail in connection with the drawings, in which.

DETAILED DESCRIPTION OF THE EXAMPLE EMBODIMENTS

Figure 1:
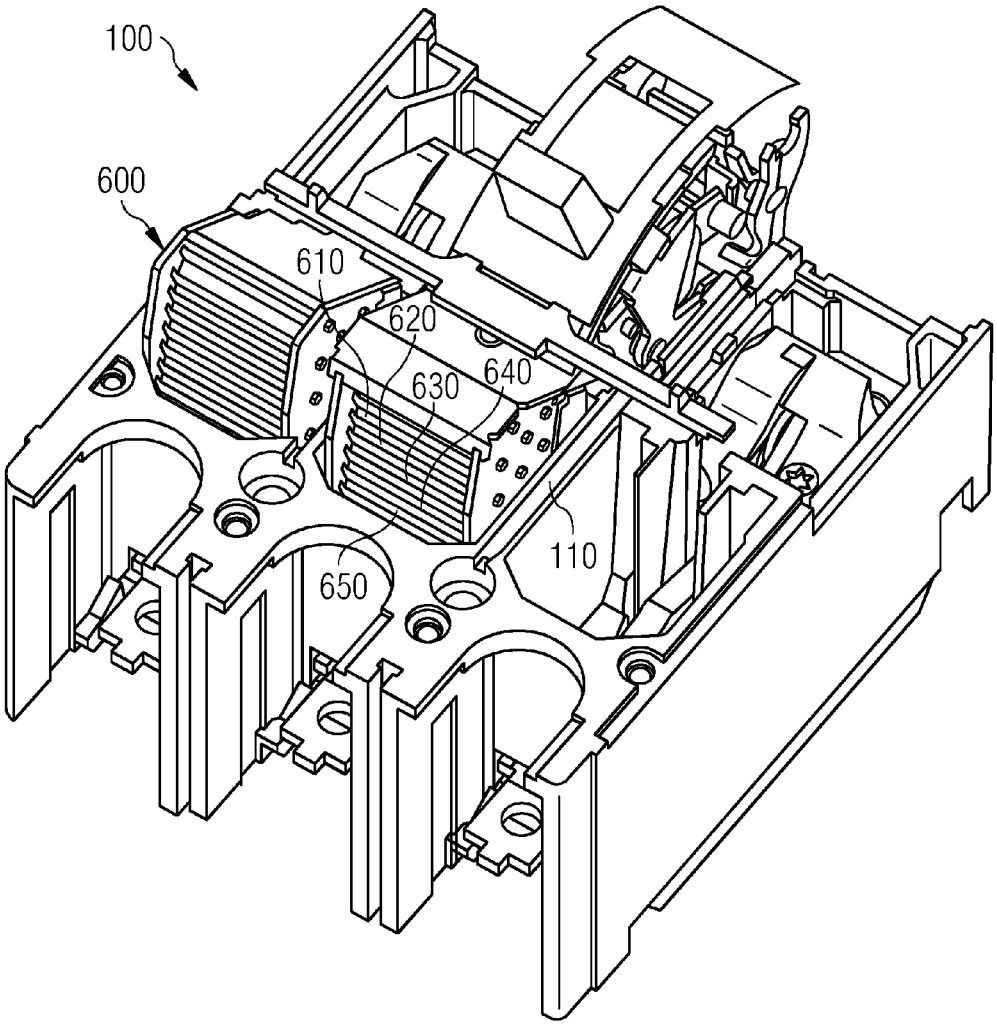
FIG. 1 shows an electrical switch with a device for quenching an arc.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The inventive switch of at least one embodiment comprises a rotatably mounted contact bridge which comprises a movable contact, wherein the movable contact interacts with a stationary contact of the electrical switch for the purpose of closing or opening the electrical circuit as a result of rotation of the contact bridge. The surfaces at the point at which contact is made between the movable contact and the stationary contact are at least partially covered by a protective material for protecting against soiling and/or damage due to contact-erosion materials, wherein the protective material is a paper-like fleece. It is advantageous here for the contact-erosion materials to be deposited preferably on the paper-like fleece and there to not adversely affect the functioning of the electrical switch. This ensures that correct opening of the switch is not impeded, even after the repeated production of contact-erosion materials.

In one refinement of at least one embodiment of the invention, the paper-like fleece is composed of a non-conductive fiber material. The paper-like fleece can be composed of a glass fiber, in particular of SiO.

Water-cleaving materials can be incorporated into the paper-like fleece. These materials can be released from the paper-like fleece when an arc occurs, and assist in quenching the arc.

In one refinement of at least one embodiment of the invention, the electrical switch additionally comprises a device for quenching an arc in a quenching chamber, wherein at least one wall of the quenching chamber is at least partially covered by the protective material. In addition, the device for quenching an arc can have at least two quenching plates.

In one refinement of at least one embodiment of the invention, the protective material covers a side wall of the quenching chamber, said side wall facing the at least two quenching surfaces. The paper-like fleece can be arranged between the at least two quenching plates and a supporting wall in the electrical switch. In an alternative refinement, the protective material covers a side wall of the quenching chamber which faces away from the at least two quenching plates.

In one refinement of at least one embodiment, the paper-like fleece is inserted into the electrical switch and remains in its position on account of the friction. In an alternative refinement, the paper-like fleece is adhesively bonded in the electrical switch.

In a further refinement of at least one embodiment, the rotatably mounted contact bridge comprises two movable contacts, wherein the movable contacts interact with two stationary contacts of the electrical switch for the purpose of closing or opening the electrical circuit as a result of rotation of the contact bridge.

At least one embodiment is directed to a method for improving an electrical switch, wherein the surfaces at the point at which contact is made between the movable contact and the stationary contact are at least partially covered by a protective material for protecting against soiling and/or damage due to contact-erosion materials, wherein the protective material is a paper-like fleece.

Embodiments of the invention is not restricted to the protection of electrical switches with rotary contact systems, but rather can also be employed in other kinds of switches.

Figure 3:
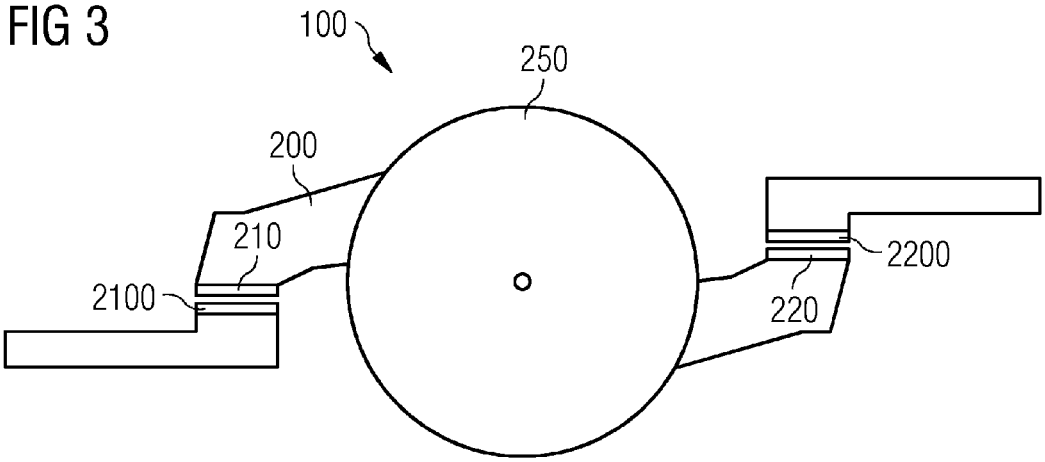
FIG. 3 shows a rotatably mounted contact bridge with movable contacts and with stationary contacts.

An electrical switch 100 is partially illustrated in FIG. 1. The electrical switch 100 comprises a rotatably mounted contact bridge 200. The contact bridge is illustrated in greater detail in FIG. 3. The rotatably mounted contact bridge 200 comprises movable contacts 210, 220, wherein the movable contacts 210, 220 interact with stationary contacts 2100, 2200 of the electrical switch 100 for the purpose of closing or opening the electrical circuit as a result of rotation of the contact bridge 200. The rotatably mounted contact bridge 200 can be mounted in a so-called rotor 250 in which said contact bridge can be mounted in an at least partially freely rotatable manner.

The electrical switch 100 according to FIG. 1 comprises a device 600 for quenching an arc in a quenching chamber 605, wherein at least one wall 110 of the quenching chamber 605 is at least partially covered by a protective material 300.

The protective material 300 is a paper-like fleece. This is a kind of batting which has been compressed to form paper. The paper-like fleece may be a ceramic fiber which can be stamped and folded. Furthermore, the paper-like fleece can be produced from SiO, at least from a non-conductive fiber material.

The device 600 for quenching an arc in the quenching chamber 605 comprises at least two quenching plates 610, 620, 630, 640, 650.

The surfaces at the point at which contact is made between movable contacts 210, 220 and stationary contacts 2100, 2200 are at least partially covered by the protective material 300 for protecting against soiling and/or damage due to contact-erosion materials. According to FIG. 1, this means that the protective material 300 which is composed of paper-like fleece is located between the wall 110 and the at least two quenching plates 610, 620, 630, 640, 650.

Figure 2A:
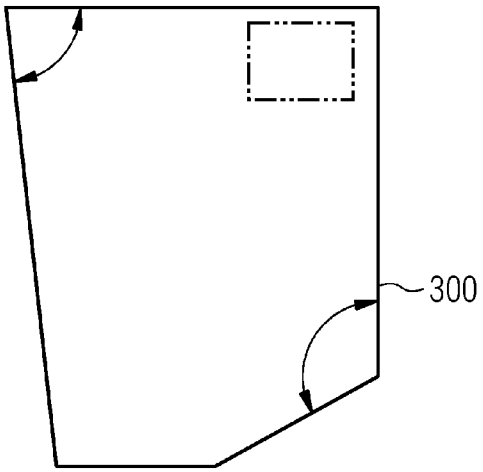
FIGS. 2A and 2B show a first and a second illustration of a protective material which is composed of a paper-like fleece.
Figure 2B:
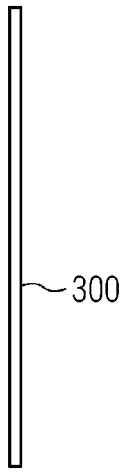

The protective material 300 which is composed of paper-like fleece is cut to shape such that it can at least partially cover the surfaces at the point at which contact is made between movable contacts 210, 220 and stationary contacts 2100, 2200. FIGS. 2A and 2B illustrate the paper-like fleece 300 in the form of an example pre-cut part. FIG. 2A shows a side surface of the paper-like fleece 300; according to FIG. 2B the protective material 300 which is composed of a paper-like fleece is approximately of uniform thickness.

The quenching chamber 605 of the device 600 for quenching an arc has walls. Said walls can also be formed by a supporting wall of the housing of the electrical switch 100. For example, the supporting wall 110 in the electrical switch 100 can be used for the protective material 300 to be arranged between it and the quenching plates 610, 620, 630, 640, 650.

Figure 4:
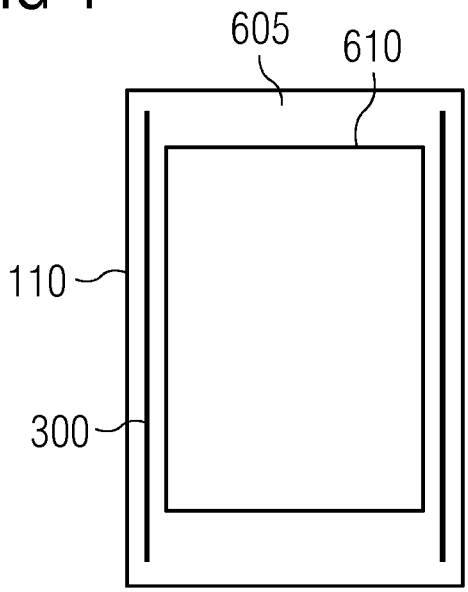
FIG. 4 shows a quenching chamber with a quenching plate and a protective material which is composed of a paper-like fleece.

FIG. 4 schematically shows the quenching chamber 605 with a quenching plate 610. The protective material 300 in the form of a paper-like fleece is arranged between the wall 110 and the quenching plate 610. The paper-like fleece can be inserted in the electrical switch 100 and remain in its position on account of its friction. As an alternative, it is likewise possible for the paper-like fleece to be adhesively bonded in the electrical switch.

Figure 5:
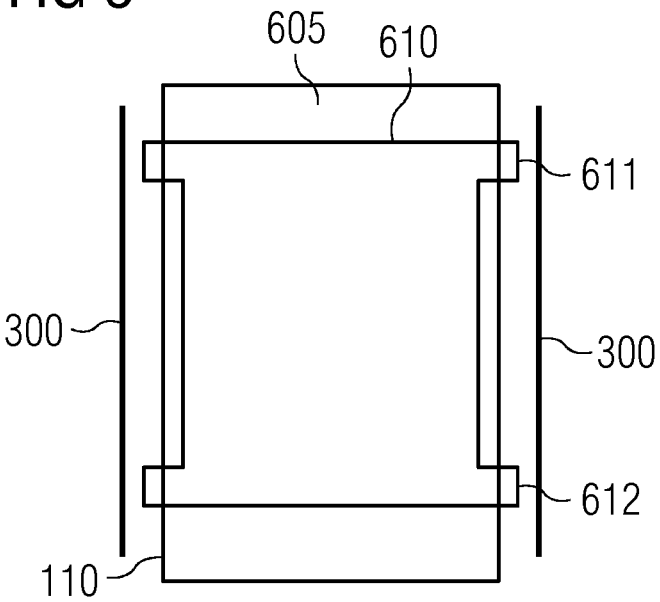
FIG. 5 shows a quenching chamber with a quenching plate and a protective material which is composed of a paper-like fleece.

FIG. 5 shows an alternative example embodiment with a quenching chamber 605 and a quenching plate 610. The quenching plate 610 has lugs 611; 612 which project through the side wall of the quenching chamber 605, as a result of which the quenching plate is held in the quenching chamber 605. The protective material 300 in the form of a paper-like fleece is arranged on the outer wall of the quenching chamber 605 and there prevents the accumulation of material which could electrically short-circuit the quenching plates. This outer wall of the quenching chamber 605 faces away from the at least two quenching plates 610; 620; 630; 640; 650.

The example embodiments show a rotatably mounted contact bridge 200 with two movable contacts 210, 220 which interact with two stationary contacts 2100, 2200 of the electrical switch 100 for the purpose of closing or opening the electrical circuit. Embodiments of the invention can likewise also be used in the electrical switches 100 which comprise only one movable contact 210 which interacts with only one stationary contact 2100.

Embodiments of the invention can likewise be implemented in a method for improving an electrical switch 100. In this case, the surfaces at the point at which contact is made between movable contacts 210, 220 and stationary contacts 2100, 2200 are at least partially covered by the protective material 300 for protecting against soiling and/or damage due to contact-erosion materials, wherein the protective material 300 is a paper-like fleece.

When an arc in an electrical switch, in particular in a power breaker, is interrupted, very high temperatures are reached, for example of several thousand degrees Celsius. As a result, surrounding materials, such as Cu, Ag or plastics, are burnt or converted into a gaseous state. Upon cooling, these products are deposited on the surrounding walls of the electrical switch and the arc chamber and form an at least partially conductive film as a coating. This coating can lead to a reduction in the dielectric strength of the electrical switch and therefore to failure.

By inserting or covering a paper-like fleece which is composed of a non-conductive fiber material, for example glass fiber, SiO fiber or the like, the gases which are produced in the switching process are separated off from the surfaces at risk, such as the arc chamber wall for example. As a result, the conductive film cannot settle on the surface and the dielectric strength of the electrical switch is ensured.

The inserted paper-like fleece 300, like a filter, prevents particles of dirt and metal beads from being blown in. In addition, the paper-like fleece 300 forms a large surface on which metal gases can be deposited.

However, owing to the fiber structure, a continuous conductive surface cannot form on the fleece, as a result of which there is no reduction in the dielectric strength.

Owing to the use of the paper-like fleece 300, the dielectric strength and three-phase strength of the materials is also at a very high level after a short circuit is interrupted. Therefore, further measures, such as increasing the creepage distance or reducing the voltage for example, are not required. In addition, low-cost base materials with a correspondingly sufficient dielectric strength can be used for the materials of the housing wall or the arc chamber in a case of this kind.

A further advantage of the paper-like fleece 300 is the option of inserting additional gases and materials into the quenching chamber in the fleece, said additional gases and materials having a positive influence on the interruptions. As a result, for example, water-cleaving materials can provide additional cooling. The additional soiling which is produced owing to a mechanism of this kind and which normally leads to a reduction in the dielectric strength is absorbed or separated off from the critical surfaces by the paper-like fleece 300.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Although the invention has been illustrated and described in detail on the basis of the preferred example embodiment, the invention is not limited by the disclosed examples and other variations can be derived herefrom by the person skilled in the art, without departing from the scope of protection of the invention.

What is claimed is:

1. An electrical switch, comprising:

a rotatably mounted contact bridge including a movable contact, the movable contact being configured to interact with a stationary contact of the electrical switch to close or open the electrical circuit as a result of rotation of the contact bridge; wherein surfaces, at a point at which contact is made between the movable contact and the stationary contact, are at least partially covered by a protective material to protect against at least one of soiling and damage due to contact-erosion materials, and wherein the protective material is a paper-like fleece.

2. The electrical switch of claim 1, wherein the paper-like fleece is composed of a non-conductive fiber material.

3. The electrical switch of claim 2, wherein the paper-like fleece is composed of a glass fiber.

4. The electrical switch of claim 1, wherein water-cleaving materials are incorporated into the paper-like fleece.

5. The electrical switch of claim 1, further comprising:

a device, configured to quench an arc in a quenching chamber, wherein at least one wall of the quenching chamber is at least partially covered by the protective material.

6. The electrical switch of claim 5, wherein the device includes at least two quenching plates.

7. The electrical switch of claim 6, wherein the protective material covers a side wall of the quenching chamber, said side wall facing the at least two quenching plates.

8. The electrical switch of claim 6, wherein the protective material covers a side wall of the quenching chamber, said side wall facing away from the at least two quenching plates.

9. The electrical switch of claim 6, wherein the paper-like fleece is arranged between the at least two quenching plates and a supporting wall in the electrical switch.

10. The electrical switch of claim 1, wherein the paper-like fleece is inserted in the electrical switch and remains in position on account of the friction.

11. The electrical switch of claim 1, wherein the paper-like fleece is adhesively bonded in the electrical switch.

12. The electrical switch of claim 1, wherein the rotatably mounted contact bridge comprises two movable contacts, wherein the movable contacts interact with two stationary contacts of the electrical switch to close or open the electrical circuit as a result of rotation of the contact bridge.

13. A method for improving an electrical switch, the method comprising:

at least partially covering surfaces, at a point at which contact is made between a movable contact and a stationary contact of the electrical switch, by a protective material to protect against at least one of soiling and damage due to contact-erosion materials, wherein the protective material is a paper-like fleece.

14. The electrical switch of claim 3, wherein the glass fiber is SiO.

15. The electrical switch of claim 2, wherein water-cleaving materials are incorporated into the paper-like fleece.

16. The electrical switch of claim 2, further comprising:

a device, configured to quench an arc in a quenching chamber, wherein at least one wall of the quenching chamber is at least partially covered by the protective material.

17. The electrical switch of claim 16, wherein the device includes at least two quenching plates.

18. The electrical switch of claim 17, wherein the protective material covers a side wall of the quenching chamber, said side wall facing the at least two quenching plates.

19. The electrical switch of claim 17, wherein the protective material covers a side wall of the quenching chamber, said side wall facing away from the at least two quenching plates.

* * * * *